United States Patent [19]

Mochida et al.

[11] Patent Number: 4,789,455

[45] Date of Patent: Dec. 6, 1988

[54] PROCESS FOR PRODUCING PITCH USED AS STARTING MATERIAL FOR THE MAKING OF CARBON MATERIALS

[75] Inventors: Isao Mochida, Fukuoka; Susumu Fujiyama, Okayama; Yukio Sakai, Kayama; Hiroyuki Otsuka, Okayama, all of Japan

[73] Assignee: Mitsubishi Gas Chemical Co. Inc., Tokyo, Japan

[21] Appl. No.: 77,211

[22] Filed: Jul. 24, 1987

[30] Foreign Application Priority Data

Jul. 29, 1986 [JP] Japan ..... 61-176704
Jun. 11, 1987 [JP] Japan ..... 62-144160

[51] Int. Cl.[4] ..... C10C 3/00

[52] U.S. Cl. ..... 208/39; 208/40; 208/44; 208/22; 423/447.4; 585/11; 585/422; 585/425

[58] Field of Search ..... 208/39, 40; 423/447.4

[56] References Cited

U.S. PATENT DOCUMENTS

| | | | |
|---|---|---|---|
| 2,271,636 | 2/1942 | Frolich | 208/40 |
| 2,454,615 | 11/1948 | Ridgway, Jr. et al. | 208/40 |
| 2,518,546 | 8/1950 | Hengstebeck | 208/40 |
| 2,525,814 | 10/1950 | Radford | 208/40 |
| 2,544,350 | 10/1950 | Olson | 208/40 |
| 2,567,342 | 3/1951 | Morris | 208/40 |
| 2,802,789 | 8/1957 | Smith | 266/285 |
| 2,834,717 | 5/1958 | Shiah | 208/39 |
| 2,992,181 | 7/1961 | Renner | 208/40 |
| 3,152,978 | 10/1964 | Fierce et al. | 208/6 |
| 3,373,101 | 3/1968 | Folkins et al. | 208/40 |
| 3,442,857 | 5/1969 | Thornton | 528/86 |
| 3,459,706 | 8/1969 | Schweitzer | 528/86 |
| 3,649,517 | 3/1972 | Kovach et al. | 208/40 |
| 4,457,828 | 7/1984 | Lewis | 208/39 |
| 4,464,248 | 8/1984 | Dickakian | 208/39 |
| 4,547,200 | 10/1985 | Shinohara et al. | 44/51 |

FOREIGN PATENT DOCUMENTS

| | | | |
|---|---|---|---|
| 090475 | 3/1983 | European Pat. Off. . | |
| 0090476 | 10/1983 | European Pat. Off. | 208/39 |
| 53-7533 | 3/1978 | Japan . | |
| 58-185612 | 3/1983 | Japan . | |

OTHER PUBLICATIONS

Interaction Among Fractions in Mesophase Pitches Derived from $AlCl_3$-Modified Mochida et al, Research Institute of Indus. Science, Kyushu Univ. 86, Kasuga 816, Fukoka, Japan, J. of Materials Science 20, pp. 3177–3113 (1985).

*Primary Examiner*—H. M. S. Sneed
*Assistant Examiner*—Helane Myers
*Attorney, Agent, or Firm*—Browdy & Neimark

[57] ABSTRACT

A process for producing pitch useful as a starting material for the manufacture of a carbon material is provided. The pitch is produced by polymerizing a condensed nuclear aromatic compound or a material containing the same. The polymerization is carried out in the presence of a hydrogen fluoride/boron trifluoride catalyst system. The condensed nuclear aromatic compounds which may be used in this process are naphthalene, anthracene, phenanthrene, acenaphthene, acenaphthylene, pyrene and mixtures thereof.

17 Claims, No Drawings

PROCESS FOR PRODUCING PITCH USED AS STARTING MATERIAL FOR THE MAKING OF CARBON MATERIALS

BACKGROUND OF THE INVENTION

The present invention relates to a process by which pitch that is suitable for use as a starting material for the manufacture of carbon fibers and other functional carbon materials is produced by polymerizing a condensed nuclear aromatic compound such as naphthalene, anthracene, phenanthrene or acenaphthene.

Mesophase pitch or isotropic pitch is produced by polymerization of naphthalene and other hydrocarbons. The process basically consists of heat-treating a hydrocarbon in the presence of a Lewis acid catalyst such as aluminum chloride at 100°-300° C., removing the added catalyst by such a technique as solvent extraction, precipitation or filtration, and further heat-treating the residue at 300°-500° C. Various versions of this method are described in Japanese Patent Publication No. 7533/1978, Journal of Materials Science, 20, pp. 3177-3183 (1985), and Japanese Patent Public Disclosure No. 83317/1986.

In all of these methods which involve the use of an aluminum chloride catalyst, the reaction is carried out at elevated temperatures, with the results so that a dehydrogenation reaction occurs as a side reaction to cause deterioration of the product pitch and that it is difficult to recover the used aluminum chloride catalyst from the pitch for further use. In addition, if the pitch produced is used as a precursor for the manufacture of carbon fibers, a trace amount of aluminum chloride or a derivative thereof remains in the carbon fibers being prepared, with the subsequent result that the strength and other properties of the fibers are considerably deteriorated during their calcination or graphitization. It is extremely difficult to remove all such aluminum chloride or derivatives thereof from the pitch or the fibers.

SUMMARY OF THE INVENTION

The present inventors conducted studies on the polymerization reaction of condensed nuclear aromatic compounds such as naphthalene, anthracene, phenanthrene, acenaphthene and pyrene and found that these compounds could be polymerized very easily in the presence of a hydrogen fluoride/boron trifluoride catalyst system which is a strong protic acid catalyst, and that the resulting polymerization product had excellent properties for use as starting or precursor pitch in the manufacture of carbon materials. The present invention has been accomplished on the basis of these findings.

Therefore, the present invention relates to a process for producing starting pitch useful in the manufacture of carbon materials, said process being characterized by polymerizing a condensed nuclear aromatic compound or a material containing the same in the presence of a hydrogen fluoride/boron trifluoride catalyst system.

DETAILED DESCRIPTION OF THE INVENTION

The starting material used in the process of the present invention is selected from among condensed nuclear aromatic compounds such as naphthalene, anthracene, phenanthrene, acenaphthene, acenaphthylene and pyrene, mixtures thereof, and materials containing such compounds or mixtures thereof. A variety of petroleum fractions, the residual oil originating from petroleum processing steps, and coal tar fractions can also be used as the starting material.

Particularly suitable starting materials are those which have low contents of nitrogen-, sulfur- and oxygen-containing compounds, all of these being basic compounds that strongly bind to the hydrogen fluoride/boron trifluoride catalyst system used as the polymerization catalyst.

The polymerization catalyst is preferably used in such an amount that from about 3 to about 20 moles of hydrogen fluoride and from about 0.1 to about 1.0 mole of boron trifluoride are present per mole of the condensed nuclear aromatic compound. No effective polymerization catalyst is provided if hydrogen fluoride or boron trifluoride is used alone.

Hydrogen fluoride (HF), when used together with boron trifluoride ($BF_3$), forms a strong protic acid, which reacts with the basic condensed nuclear aromatic compound (Ar) to form a complex according to the following scheme:

$$Ar + HF + BF_3 \rightarrow H^+ ArBF_4^- \quad (1)$$

The resulting complex dissolves in excess HF to form a complex solution. The intended polymerization reaction proceeds very smoothly in a HF solution under mild conditions. In this way, HF functions as a solvent that allows the intended polymerization to proceed smoothly. Although HF is used in an excess amount, it need not be used in an amount exceeding 20 moles per mole of the condensed nuclear aromatic compound.

The polymerization reaction is carried out at a temperature in the range of from about 0° to about 150° C., preferably from about 30° to about 100° C. An optimum reaction temperature is selected in accordance with the specific type of starting material used but conditions that cause excessive polymerization will present difficulty in subsequent catalyst recovery and should be avoided.

The time required to complete the polymerization reaction varies with the type of starting material used, the temperature, and the amount of catalyst used but is typically within the range of from about 5 to about 300 minutes, preferably from about 15 to about 180 minutes.

The polymerization reaction is performed by mixing under agitation the starting material and the catalyst fed into a corrosion-resistant reactor equipped with a stirrer. The procedures of reaction may be batchwise or continuous. With a view to providing ease in supply to the reactor, a solid starting material may be dissolved in an appropriate inert organic solvent. An advantageous inert organic solvent is an aromatic hydrocarbon such as benzene, toluene or xylene.

When mixed with the catalyst, the starting condensed nuclear aromatic compound forms a complex which, after dissolving in the HF phase, undergoes rapid polymerization to be converted to a solution of a polymer [(Ar)n] in complex form. In other words, the complex is in equilibrium with the produced polymer and the catalyst components as follows:

$$HF + BF_3 + (Ar)n \rightleftharpoons H^+(Ar)nBF_4^- \quad (2)$$

Therefore, by heating the reaction mixture to distill off the volatile components, HF and $BF_3$, the catalyst can be recovered while yielding the pitch as the polymerization product in a separated form.

Specific procedures for separating and recovering the catalyst components (HF and $BF_3$) from the pitch are as follows.

Catalyst separation by a batch system consists of heating the reaction solution (i.e., a solution of the polymer complex with HF-$BF_3$) either under atmospheric or superatmospheric pressure so as to extract the HF and $BF_3$ from the reactor as a vapor phase, and finally recovering the polymer as molten pitch. In order to ensure smoothness in these procedures, the reaction solution may be heated, with a suitable organic diluent such as benzene, toluene or halogenated aromatic hydrocarbon (these are good pitch solubilizers, have suitable vapor pressures, and are fairly inert to HF and $BF_3$) being supplied to or initially present in the reaction system, so that HF and $BF_3$ are evaporated together with the vapor of such diluents. Heating may be external (i.e., through a jacket) or the vapor of the diluent may be supplied to achieve direct heating.

Catalyst separation may also be performed by a continuous method with a distillation column, with the inert diluent being refluxed, which is continuously fed with the polymerization reaction solution so as to extract the HF and $BF_3$ vapors from the top of the column, with the pitch being recovered from the bottom of the column in the form of a solution in the diluent.

Whichever method is used, the temperature necessary for thermally decomposing the solution of polymer complex and recovering the HF and $BF_3$ is generally within the range of from about 100° to about 250° C., preferably from about 120° to about 180° C. At temperatures below 100° C., it is difficult to achieve satisfactory catalyst separation. Temperatures higher than 250° C. are simply unnecessary.

The pressure required for HF and $BF_3$ recovery is typically in the range of from about 0 to 10 atmospheres, preferably from about 1 to 5 atmospheres. The higher the pressure, the more difficult it is to separate HF and $BF_3$ from the pitch, but on the other hand facility is imparted to the recycling of the recovered catalyst, in particular gaseous $BF_3$, at the higher pressures.

The pitch obtained by the procedures described above is substantially free from HF and $BF_3$ and may be processed by distillation, solvent extraction, heating or combinations of these operations so as to make a product that has properties suitable for use as a starting material for the manufacture of carbon fibers and other carbon materials.

If desired, the pitch synthesized by the process of the present invention may be processed by known methods of heat treatment such as those described in Japanese Patent Public Disclosure Nos. 101915/1981 and 185612/1983; as a result of these treatments, the pitch readily forms a mesophase and acquires properties that make it particularly adaptive for use as the starting material, or precursor thereof, for the manufacture of various carbon materials.

According to the process of the present invention, a condensed nuclear aromatic compound such as naphthalene, anthracene, phenanthrene, acenaphthene or pyrene can be polymerized with great ease, and the additional advantages of this process are listed below.

(1) The condensed nuclear aromatic compounds mentioned above may be individually used as the starting material for the process of the present invention. Alternatively, two or more of these compounds may be deliberately used in mixture with a view to producing pitch that has properties different from those of the pitch prepared from each of the starting materials. Various tar oils containing one or more of these condensed nuclear aromatic compounds can also be used as starting materials.

(2) According to the method of the present invention, HF and $BF_3$ used as catalyst components can be readily separated from the product and may be subjected to further use as catalysts.

(3) The pitch produced by the present invention is substantially free from the HF and $BF_3$ used as catalyst components and, hence, possesses excellent properties for use as a starting material in the manufacture of carbon fibers and other functional carbon materials.

(4) The pitch produced by the process of the present invention can be treated with any of the known methods described hereinabove so as to prepare mesophase pitch in high yield. The resulting mesophase pitch is readily spinnable and the spun filaments may be stabilized carbonized, and optionally graphitized, to make high-strength carbon or graphite fibers.

(5) The pitch prepared in accordance with the present invention contains an appropriate amount of active hydrogen and can be readily stabilized.

For these features, the process of the present invention has a great industrial significance.

The following examples are provided for the purpose of further illustrating the present invention but are in no way to be taken as limiting.

EXAMPLE 1

Naphthalene (1 mole) and HF (8 moles) were charged into an autoclave and $BF_3$ (0.5 moles) was fed into the autoclave over a period of about 2 minutes with gentle stirring. As $BF_3$ was supplied, naphthalene dissolved and its polymerization started immediately. The temperature in the autoclave was raised to 40° C. and stirring was continued for an additional 30 minutes to complete the reaction. The reaction solution was drawn into cold water and the free pitch was dissolved in warm xylene and washed with warm water three times. Thereafter, xylene was distilled off under vacuum to recover the pitch. The pitch had a softening point of about 60° C. and contained no detectable amount of naphthalene. An elemental analysis of the pitch was 92.1% C and 7.9% H, which were substantially equal to the theoretical values for naphthalene (92.3% C and 7.7% H).

EXAMPLE 2

As in Example 1, naphthalene (1 mole) was polymerized at 20° C. for 60 minutes in the presence of HF (5 moles) and $BF_3$ (0.5 moles). The resulting pitch had a softening point of 45° C. and was found to consist of 92.2% C and 7.8% H by elemental analysis.

EXAMPLE 3

Naphthalene (1 mole) was polymerized at 100° C. for 60 minutes in the presence of HF (5 moles) and $BF_3$ (0.4 moles). The resulting pitch was treated at 380° C. for 10 hours under a nitrogen stream to obtain substantially anisotropic mesophase pitch in a yield of 40 wt %.

The mesophase pitch thus obtained had a softening point of 300° C. and was readily spinnable at 350° C. The pitch was stabilized and carbonized under specified conditions to produce carbon fibers of high quality.

EXAMPLE 4

Using an autoclave (inner capacity: 200 ml) equipped with a stirrer, the condensed nuclear aromatic compounds shown in Table 1 were polymerized by the following procedures.

The condensed nuclear aromatic compounds (0.5 ml) was charged into the autoclave. After addition of 3 ml of HF, $BF_3$ gas (0.25 moles) was fed into the autoclave with gentle stirring. As a result, the hydrocarbon dissolved as it absorbed $BF_3$.

Polymerization was performed for 3 hours, with the temperature being controlled by means of an external jacket. Thereafter, the vent on the autoclave was opened and the contents were gradually heated to between 180° and 200° C. at atmospheric pressure so as to recover substantially all of the HF and $BF_3$ in gaseous form. Thereafter, the molten pitch was withdrawn from the autoclave.

The specific conditions of polymerization of each of the starting materials used, the yields of pitch produced and its properties are also shown in Table 1. The yield of pitch is expressed as the weight percentage, based on the starting material, of the pitch after it was washed with ethanol to remove unreacted matter and any other impurities.

TABLE 1

| Starting material | polymerization temperature °C. | pressure kg/cm² | yield wt % | melting point of pitch °C. | C/H ratio of pitch |
|---|---|---|---|---|---|
| anthracene | 60 | 3.5 | 95 | 150 | 0.71 |
| phenanthrene | 40 | 2.8 | 90 | 128 | 0.71 |
| pyrene | 40 | 0.8 | 52 | 133 | 0.61 |
| acenaphthene | 60 | 2.0 | 87 | 155 | 0.82 |
| acenaphthylene | 60 | 2.5 | 89 | 260* | 0.68 |

*recovered in a solid form

EXAMPLE 5

The pitch synthesized in Examples 1 and 4 was carbonized and subjected to evaluation. Pitch carbonization was conducted under two different conditions: (1) firing at 600° C. for 2 hours at atmospheric pressure; and (2) firing at 550° C. for 2 hours at 10 kg/cm²G.

The carbon yields of the carbonized products of the pitch prepared from the respective starting materials are shown in Table 2. Under observation with a polarizing microscope, the carbon products had a flow texture, which indicated that carbonization had occurred after the formation of a mesophase structure.

TABLE 2

| Starting material | carbon yield (%) atmospheric pressure | carbon yield (%) 10 kg/cm² G |
|---|---|---|
| naphthalene | 28 | 56 |
| anthracene | 64 | 80 |
| phenanthrene | 58 | 76 |
| pyrene | 42 | 84 |
| acenaphthene | 30 | 56 |
| acenaphthylene | 50 | 75 |

EXAMPLE 6

An autoclave (inner capacity: 500 ml) equipped with a stirrer was charged with 1 mole (128 g) of naphthalene and 0.1 mole (17.8 g) of anthracene. After addition of 6 moles (200 g) of HF, $BF_3$ (0.6 moles) was charged so that it was absorbed by the starting materials. Polymerization was then performed at 80° C. for 3 hours. Thereafter, the autoclave was opened to the atmosphere and benzene (200 g) was added to the polymerization product. By external heating, all of the benzene added was distilled off together with the catalyst vapors. The residual pitch was further distilled under vacuum to remove the unreacted naphthalene. The yield of weight basis of the obtained pitch was 95% of the total weight of naphthalene and anthracene. The pitch had a melting point of 110° C. and a H/C ratio of 0.79.

EXAMPLE 7

Fractions (b.p. 200°–370° C.) that had been obtained by distillation of coal tar and which contained 25 wt % anthracene were polymerized in an autoclave of the same type as used in Example 6. Two hundred grams of the coal tar fraction was charged into the autoclave and polymerized at 80° C. for 3 hours in the presence of HF (120 g) and $BF_3$ (0.6 moles). Thereafter, the reaction product was heated to 200° C. at atmospheric pressure so as to separate the catalysts HF and $BF_3$ by vaporization. Subsequently, the polymerized oil was withdrawn and the unreacted oil distilled off under vacuum to obtain polymerized pitch in a yield of 61% of the starting fraction. The pitch had a melting point of 59° C. and a H/C ratio of 0.75.

What is claimed is:

1. A process for producing pitch capable of being converted to a mesophase by heat treatment, both the pitch and mesophase being useful as a starting material for the manufacture of carbon material, said process comprising polymerizing a condensed nuclear aromatic compound or a material containing a condensed nuclear aromatic compound in the presence of a hydrogen fluoride/boron trifluoride catalyst system, wherein said condensed nuclear aromatic compound is selected from the group consisting of naphthalene, anthracene, phenanthrene, acenaphthene, acenaphthylene, pyrene and mixtures thereof, wherein said material containing a condensed nuclear aromatic compound is selected from the group consisting of a petroleum fraction, a residual oil originating from petroleum processing steps, and a coal tar fraction, wherein said hydrogen fluoride is used in an amount of from about 3 to about 20 moles and said boron trifluoride in an amount of from about 0.1 to about 1.0 mole per mole of the condensed nuclear aromatic compound.

2. A process according to claim 1 wherein the polymerization is carried out at a temperature in the range of from about 0° to about 150° C.

3. A process according to claim 2 wherein the polymerization temperature is in the range of from about 30° to about 100° C.

4. A process according to claim 1 wherein the polymerization is carried out for a period of from about 5 to about 300 minutes.

5. A process according to claim 4 wherein the polymerization period is in the range of from about 15 to about 180 minutes.

6. A process according to claim 1 wherein the polymerization is performed in the presence of an inert organic solvent.

7. A process according to claim 6 wherein the inert organic solvent is an aromatic hydrocarbon.

8. A process according to claim 7 wherein the aromatic hydrocarbon is selected from the group consisting of benzene, toluene and xylene.

9. A process according to claim 1 which further includes the step of heating the reaction mixture after polymerization so as to vaporize and recover the catalyst components in the mixture.

10. A process according to claim 9 wherein the vaporization of the catalyst components is carried out at a pressure in the range of from about 0 to about 10 atmospheres.

11. A process according to claim 10 wherein the pressure is in the range of from about 1 to about 5 atmospheres.

12. A process according to claim 9 wherein the reaction mixture is heated at a temperature in the range of from about 100° to about 250° C.

13. A process according to claim 12 wherein the heating temperature is in the range of from about 120° to about 180° C.

14. A process according to claim 9 wherein the evaporation and recovery of the catalyst components are effected in the presence of an inert organic diluent, with the resulting pitch being recovered as a solution in the diluent.

15. A process according to claim 14 wherein the diluent is selected from the group consisting of benzene, toluene and a halogenated hydrocarbon.

16. A process according to claim 14 wherein the diluent is supplied into the reaction system in the form of a vapor so as to heat the reaction mixture.

17. A process according to claim 14 wherein the evaporation and recovery of the catalyst components and the recovery of the pitch product are performed continuously in a distillation column, with the diluent being refluxed into the distillation column while the reaction mixture is continuously supplied into said diluent under reflux.

* * * * *